United States Patent [19]

Smollar et al.

[11] Patent Number: 4,997,187

[45] Date of Patent: Mar. 5, 1991

[54] TOY VEHICLE SLOT TRACK

[75] Inventors: Marvin Smollar, Northbrook, Ill.; Lo C. Kai, Kowloon; Kwok S. Kit, Hong Kong, both of Hong Kong

[73] Assignee: Marchon, Inc., Arlington Heights, Ill.

[21] Appl. No.: 344,285

[22] Filed: Apr. 27, 1989

[51] Int. Cl.[5] ..... A63H 18/12

[52] U.S. Cl. ..... 273/86 B; 273/86 R; 238/10 E; 238/10 F; 446/446

[58] Field of Search ..... 273/86 R, 86 B; 238/10 E, 10 F; 446/446

[56] References Cited

U.S. PATENT DOCUMENTS

| | | | |
|---|---|---|---|
| 3,206,122 | 9/1965 | Frisbie et al. | 273/86 B X |
| 3,476,389 | 11/1969 | Hok-Shou | 273/86 B |
| 3,510,631 | 5/1970 | Weinberg et al. | 273/86 B X |
| 3,712,615 | 1/1973 | Staats et al. | 273/86 R |
| 4,082,220 | 4/1978 | Cheng et al. | 238/10 F |
| 4,091,995 | 5/1978 | Barlow et al. | 238/10 F X |

FOREIGN PATENT DOCUMENTS

| | | | |
|---|---|---|---|
| 2443858 | 8/1980 | France | 238/10 F |

*Primary Examiner*—Edward M. Coven
*Assistant Examiner*—Raleigh W. Chiu
*Attorney, Agent, or Firm*—Laff, Whitesel, Conte & Saret

[57] ABSTRACT

A track section for a slot track racing game has a double walled box channels formed by alignment projections and receptacles therefore on each of the opposite sides of a track. A pair of hooks prevent accidental disconnection of the track sections responsive to random movements. The hooks have dependent fins which concentrate bending forces to the root ends thereof to preclude random bending under stress conditions. A lap counter gives a signal after a slot track vehicle has made a predetermined number of laps.

5 Claims, 3 Drawing Sheets

TOY VEHICLE SLOT TRACK

This invention relates to junctions for joining two parts of a toy and more particularly to a toy vehicle slot track racing game, including a lap counter and a game winning signal.

Many toys, games, and the like require an assembly of parts, which hold firmly while in use and yet may later be quickly and easily disassembled for storage. By way of example, such an assembly of parts may be the tracks for a model railroad, automobile race track, or the like. This type of track often includes electrical rails which require connectors that provide secure and tight connections with adequate contact pressure. The track sections should be mechanically joined securely enough to stay together while children play with it, even if they accidentally step on, kick, or twist it. The track must be aligned accurately enough for a toy vehicle to follow it without danger of derailing.

The track sections should be inexpensive and as sturdy as possible when subjected to the kind of abuse which a child might inflict. They should be simple to use so that a child can assemble, manipulate, and disassemble them. The junction must withstand longitudinal, sideways or lateral, and torsional stresses. Still, the junction must be assembled and disassembled by a use of the physical strength of a child; therefore, merely increasing the mechanical strength of parts is no answer. Thus, there are many considerations which go into the design of a good track and track junctions.

Some of the prior track junctions were concerned only with alignment. For example some track junctions have flared end pieces which fit into somewhat triangular recesses on confronting track sections. This type of track junction resists a longitudinal pull, but it comes apart when subjected to a vertical pressure or a twisting motion. Another type of junction has pins on one part which fit into sockets or recesses on another part. These junctions resist differentials in vertical pressure, but they do not resist a longitudinal pull.

Perhaps it might be well to describe some earlier efforts at track improvements. For example, the junction for one track had two sections which slid sideways into each other, as shown in U.S. Pat. Nos. 3,830,426; 4,195,776; and 4,241,875. This track was not immune to problems caused by lateral or sidewise stress and to rotation.

Another junction is shown in U.S. Pat. Nos. 4,082,220; 4,084,746; 4,231,517; and 4,286,752. Here the track sections are inserted longitudinally into each other at confronting ends. This track junction incorporated hooks to hold the ends together, but the hooks are free to bend over an extended length thereof and, therefore, to release responsive to unexpected stress, as where a track goes over a lump from a rug to a hardwood floor. Another problem with this track junction is that its electrical connections depend for contact pressure on a cam action between confronting triangular or wedge frustrum side pins which are supposed to align and wedge conductive strips together.

If the track does not go in a perfectly straight line, the track sections lever against each other. Then, the caming action often fails to maintain adequate contact pressure. For example, a child may bank a track or force parts together in order to change a turning radius or to complete a track loop with too few track sections, for example. Since cost restraints prevent these toys from using expensive material, the electrical contacts often oxidize to create continuity problems when adequate contact pressure is lost.

Still another problem with the track using pins in the form of the triangular or wedge frustrum is that if a side wise or torsional stress is put on the track, the pins on one side tend to pull apart. As they do try to pull apart, an even greater stress is placed upon progressively thinner cross sections of the pins. Thus, these junctions leave much to be desired.

Regardless of how the track sections fit together, a repeated assembly and disassembly might deteriorate electrical connectors as when a socket tends to expand. Also, an oxide may build up on an electrical contact to make a high resistance contact, possibly leading to faulty operation. Some times, the loosened joint tends to separate mechanically, thus leading to either intermittent or complete inoperativeness.

Once a junction is designed, it should be usable with a number of different toys—not only tracks, but also houses, fences, and many other things may require parts to be assembled and disassembled. Therefore, although the term "track" is used herein in order to provide a specific illustration of the inventive concepts, the invention and the attached claims are to be construed broadly enough to cover all suitable junctions.

The particular track which is shown and described herein is used as a slot track. This kind of game enables children to race their vehicles around a closed track for a number of laps. To facilitate such a race, it is good to provide a lap counter which keeps an accurate count of the relative positions of the two vehicles and gives a winner's signal when the first vehicle completes a predetermined number of laps. Such a lap counter and winner signal must have a relatively low cost and be highly reliable.

Accordingly, an object of the invention is to provide new and improved junctions for joining two mechanical parts especially in a child's game. Here an object is to provide junctions for forming toy tracks, lay outs, and the like. In this connection, an object is to provide reliable electrical connections between adjacent track sections.

Another object of the invention is to provide new and improved slot track racing games. Here, an object is to provide a lap counter and winner signal.

In keeping with an aspect of the invention, these and other objects are accomplished by molded plastic track sections having conductive strips embedded therein. Each track section includes a combination of aligning box channel connectors, and two interlocking hooks. The aligning connectors include a projections and socket which form a sturdy box channel at each of the edges of the track. The hooks are rigid through out most of their length and are engaged by pushing them together and are disengaged by pressing down on the track at a specific point which is over the hooks. As the hooks separate responsive to the downward pressure, the tracks sections may be pulled apart. If they are not so pulled while the hooks are pressed downwardly simultaneously, the hooks reconnect when the downward pressure disappears. This way, the track sections are firmly held together until the user intentionally wants to separate them. A geneva movement is advanced one step each time that a toy vehicle passes over a given track location. After a predetermined number of passes, a winner's flag pops-up.

An embodiment of the invention is shown in the attached drawings, wherein.

Figure 1:
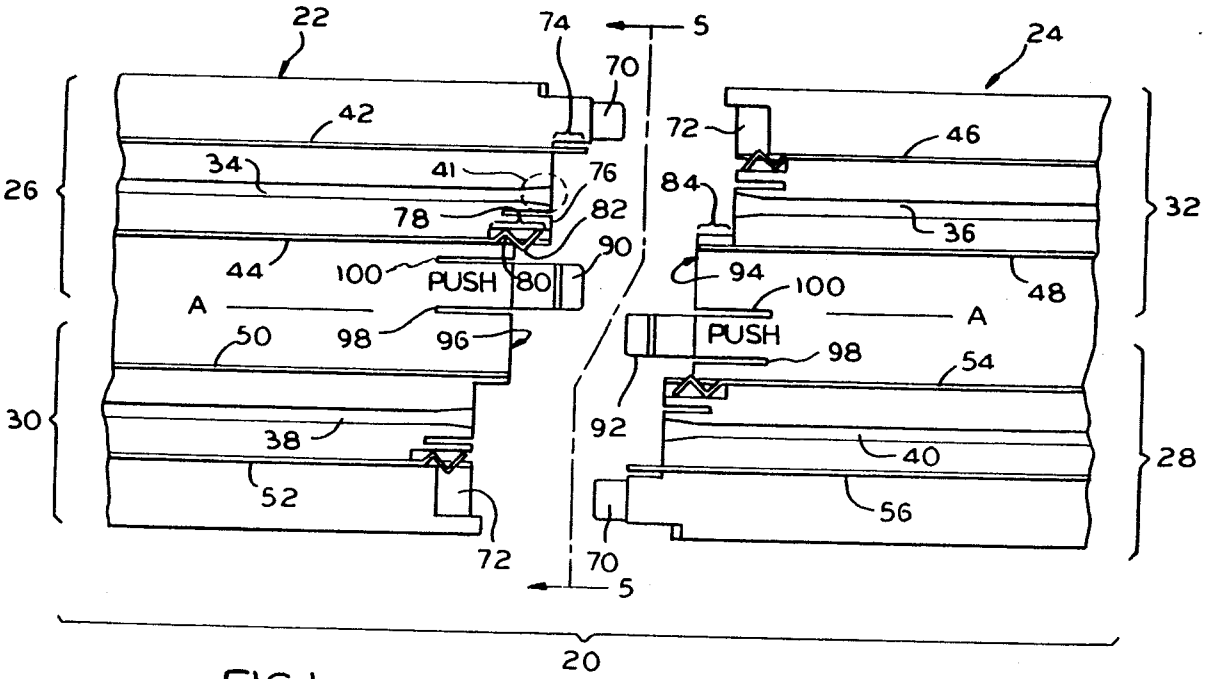
FIG. 1 is a plan view showing the junction at two confronting ends of molded, plastic track sections.

FIG. 1 shows the inventive junction 20 which is between the ends of two preferably molded plastic track sections 22, 24. A line A—A separates the track junction into two halves which are mirror images of each other. Thus, the upper half 26 of section 22 is identical to the lower half 28 of section 24. Likewise, the lower half 30 of section 22 is identical to the upper half 32 of section 24.

The track junction must be able to maintain its physical connection over varying configurations and angles experienced during the usual and varied lay out of a toy road race, or the like. The junction connection should be maintained regardless of whether the track is placed on a uniformly flat surface (such as a wood floor), goes over lumps (such as at the edge of a rug), is angled along a banked curve, or is twisted into some kind of non-standard lay out.

Two slots 34, 36 form a first track which receives a dependent member on a vehicle for guiding it while it is racing over the track. Another two slots 38, 40 form a second track. The ends of the slots are chamfered, as at 41, in order to guide the dependent member on the vehicle across the junction.

Two electrical conductors are practically embedded in the track on opposite sides of each slot in order to energize an electric motor in the vehicle which is following the track. For example, the conductors 42, 44 are on opposite sides of the slot 34. In a similar manner, conductors 46, 48 are on opposite sides of slot 36; conductors 50, 52 are on opposite sides of slot 38; and conductors 54, 56 are on opposite sides of slot 40. The upper edges of these conductors project above the plastic forming the track.

Accordingly, an object of junction 20 is to align slots 34, 36 and slots 38, 40 to provide two smooth and continuous tracks with two aligned and continuous electrically conductive strips (42, 46; 44, 48; 50, 54; and 52, 56) on opposite sides of each slot with adequate contact pressure at the junction. This means that there should be no movement of track section 22 relative to track section 24 and that each conductor segment is electrically joined to its neighbor segment with a reliable contact pressure.

Figure 2:
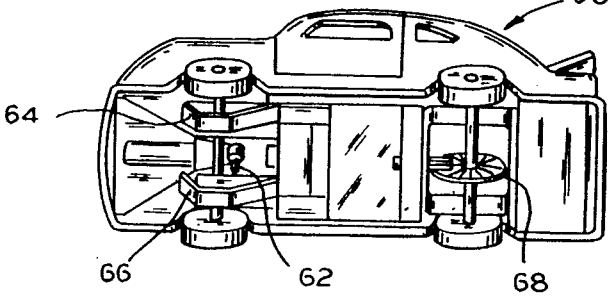
FIG. 2 is a perspective view of the underside of a toy car which may be raced over the track of FIG. 1.

A vehicle 60 (FIG. 2) traveling at a relatively high speed, has a guiding pin 62 dependent therefrom which fits into the slot 34, 36, for example. A pair of sliding shoes 64, 66 on opposite sides of dependent pin 62 ride on and make electrical contact with the embedded conductor strips 42, 46 and 44, 48 in order to pick up the power for driving an electrical motor 68. The guiding pin 62 should pass smoothly from slot 34 to slot 36. The shoes 64, 66 should not leave an energized conductive strip. Obviously, therefore, the track sections 22, 24 should be almost perfectly aligned and thereafter should not move relative should to each other.

Box channels are formed adjacent opposite edges of the track sections in order to give both strength and rigidity to the assembled track. More particularly, in order to align the track sections 22, 24, a relatively long alignment projection 70 with rectangular cross section is formed on one side of each track section 22, 24 and a mating hole or rectangular receptacle 72 is formed on the opposite side of the track. The relatively long projection 70 with rectangular in cross section is strong enough so that once seated in the receptacle, the two track sections are mechanically joined as one, by a pair of sturdy box channels. The track sections are prevented from moving relative to each other in response to any reasonably anticipated transverse or twisting forces. The slots and conductors are aligned within an acceptable degree of precision to insure the smooth transition of the vehicle, as it moves over the track.

Figure 5:
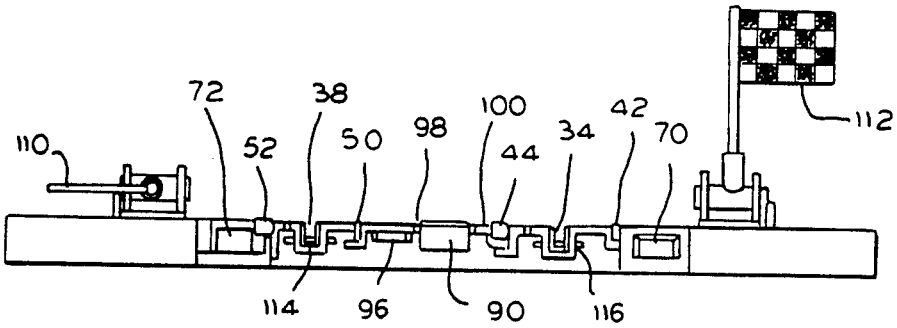
FIG. 5 is an end view of a track section taken along line 5—5 of FIG. 1.

The conductors 42, 44 etc. are embedded in the plastic with only a small portion of an edge of the strip projecting above the track, as best seen in FIG. 5. The flat surface of the ends of the conductive strips are close to and fully supported by the adjacent plastic, as conductive strip 42 is shown to be supported by the rectangular alignment projection 70 in the region 74 (FIG. 1) and the conductive strip 44 is shown to be supported by plastic 76 in region 78. The end of strip 44 is bent into an angular or triangular form at 80, 82 to apply both a substantial contact pressure and a mechanical rubbing against strip 48 in region 84. Thus, the conductive strips bridge the junction 20, with adequate contact pressure and with no break in the electrical continuity that is being experienced by the sliding shoes 64, 66 (FIG. 2) on the vehicle. The mechanical rubbing tends to clean off any oxide that might tend to form.

A pair of hooks 90, 92 (FIG. 3) are formed on the ends of the track sections 22, 24, there being one hook on each track section. A keeper 94 is opposite hook 90 and a keeper 96 is opposite hook 92, there being one keeper on each track section. Thus, as the two track sections are pushed together, hook 90 snaps over keeper 94 and hook 92 snaps over keeper 96. Thereafter, it is impossible to pull the tracks sections apart by an application of any reasonably expected amount of force, applied in almost any direction.

Figure 3:
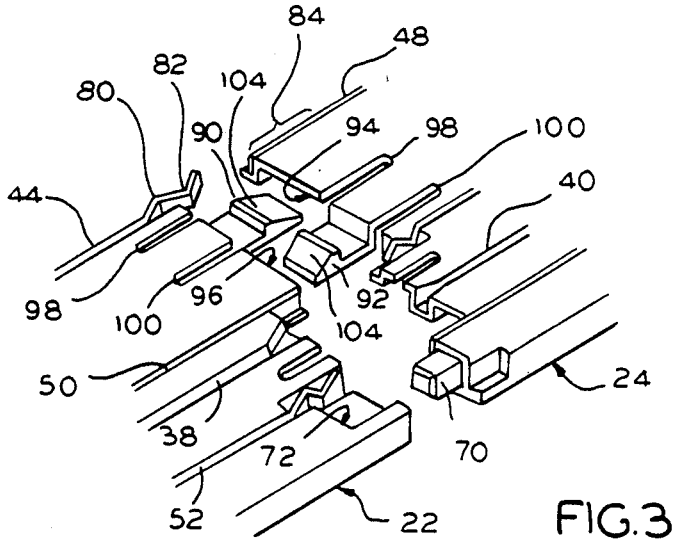
FIG. 3 is a perspective view of parts of the track sections seen in FIG. 1.
Figure 4:
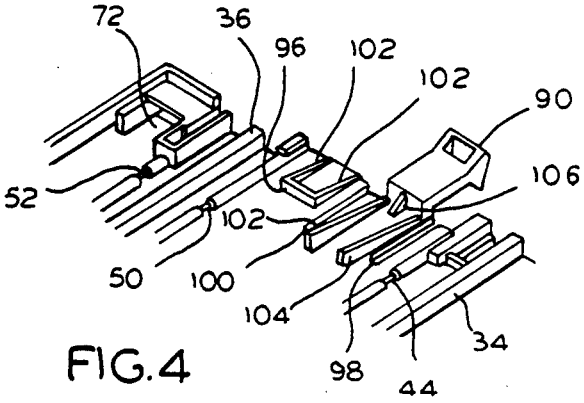
FIG. 4 is a perspective view of a part of the underside of one end of the track section.
Figure 6:
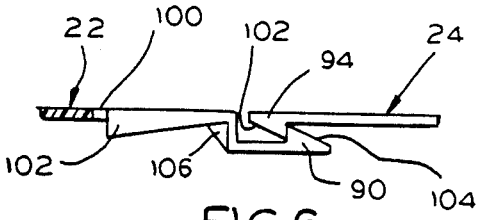
FIG. 6 shows a hook in a locked condition.
Figure 7:
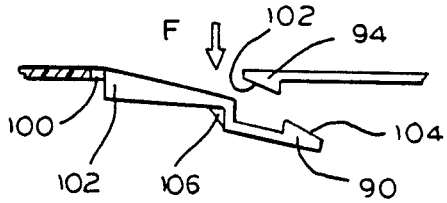
FIG. 7 shows the same hook in an unlocked condition.

The molded plastic has a pair of slots 98, 100 formed on opposite sides of the hooks 90, 92, thereby forming them into cantilever springs. FIG. 4 shows the underside of the cantilever spring for hook 90, which is molded with stiffening ribs 102, 104, 106 to concentrate bending forces in the area at the roots of slots 98, 100 and to eliminate unwanted random bending along the length of the spring. Shown next to hook 90 is the keeper 96, for receiving the hook 92 (FIGS. 1, 3). The keeper 94 for hook 90 is shown in FIGS. 6 and 7, and is indicated in FIGS. 1, 3. As the hook is pressed against the keeper, mutually inclined planes 102, 104 (FIG. 6) guide the hooks over the tops of the keepers. In this hooked state, the track sections 22, 24 cannot be pulled apart by any reasonably expected force.

In order to unhook the track sections, a force F (FIG. 7) is applied downwardly on the top of the cantilevered hook 90. With the stiffening ribs 102, 104, 106, the hook 90 bends in only the area at the roots of the slots 98, 100, as shown in FIG. 7. The hook 90 is free of its keeper 94 and the track sections 22, 24 may be pulled apart. Preferably, the mold which makes the track sections 22, 24 is inscribed to mold suitable instruction words in the track sections such as, "push to release, then separate". This inscription is represented by the word "push" on hooks 90, 92 (FIG. 1).

An advantage of the cantilevered hook construction shown in FIGS. 6, 7 is that a positive action is required in order to disconnect one track section from another because both hooks must be pushed down simultaneously with a manual pull on the track sections. This is easy to do. Hold one track section in one hand and the adjacent track section in the other hand. Simultaneously push both cantilevered hooks with the thumbs of the two hands while pulling the track sections apart. However, if a child is walking on the track, for example, it is extremely unlikely that both hooks will be unhooked at the same time that a pull is applied.

Also, the alignment projecting 70 are quite sturdy. The socket part 72 fully encloses the projection 70 to form a double wall box channel at the edges of the track. The projection 70 is long enough so that it will not pull out of socket 78 if the two track sections are levered against each other in a side ways direction. If the child stands on or twists the track, there is no change in the mutual alignment of the two track sections which might lead to both hooks disengaging simultaneously.

To give a concrete example of when the inventive junction might be used, reference is again made to a toy slot track racing game. During the game two checkered flags are laying in a lowered position, as flag 112 is shown laying down in FIGS. 8, 9. Each time that the dependent pin 62 (FIG. 2) on a toy vehicle passes the flags, it moves a lever arm 114, 116 (FIGS. 5, 6) to advance a lap counter. The flag raises when the vehicle drives the lap counter to a specific count (such as 10-completed laps). Flag 110 is shown in a down position and flag 112 is shown in a raised position in FIG. 5. Since the first vehicle racing in slot 34 has raised flag 112 and the second vehicle racing in slot 38 has not yet raised its flag 110, the first vehicle is declared winner.

Figure 8:
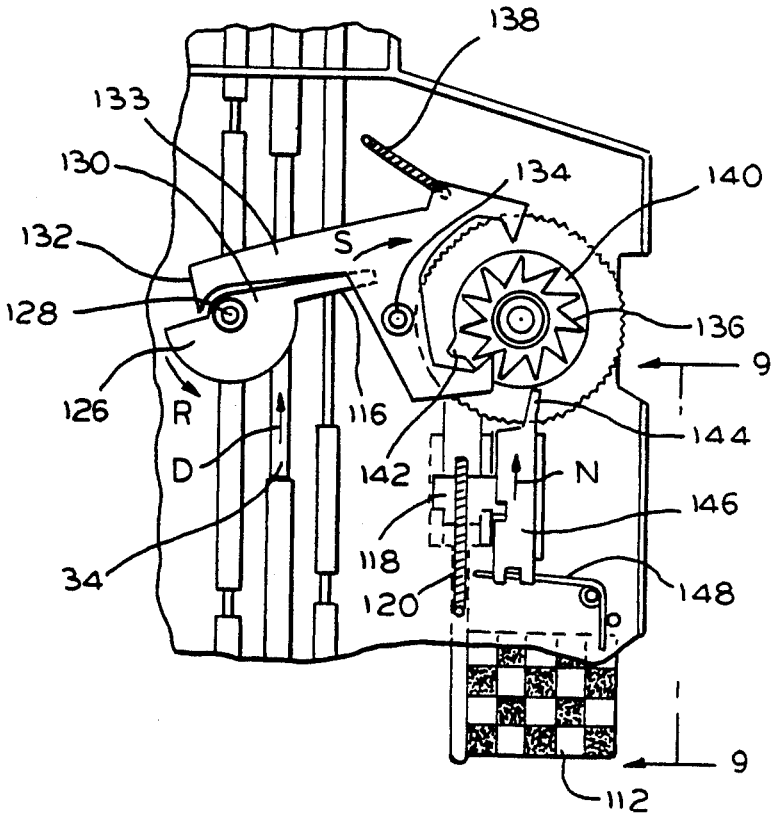
FIG. 8 is a plan view of a lap counter and pop-up flag assembly.
Figure 9:
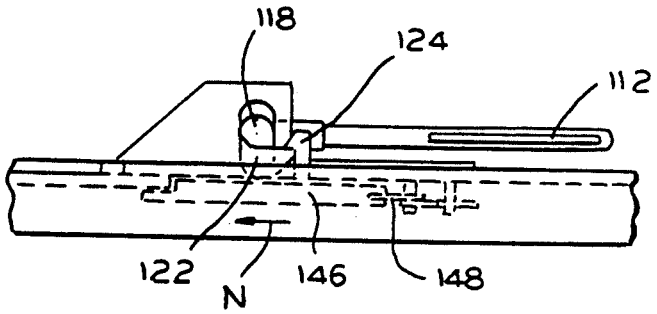
FIG. 9 is a side elevation of a latch and pop-up flag assembly, with the flag in a lowered position.

The lap count mechanism is shown in FIG. 8. The flag 112 is mounted on a journaled shaft 118 which has a coiled spring 120 partially wrapped around it. Unless shaft 118 is restrained from moving, the spring 120 contracts and turns the shaft, thereby raising flag 112. FIG. 9 shows that the shaft has a catch 122 integrally formed thereon. A spring biased, sliding latch 124 normally holds the catch 124 in a flag down position. When the latch 124 moves away from its normal position (FIG. 10), catch 122 is released; whereupon, spring 120 pulls flag 112 to a raised position.

The lap counter is operated by dependent pin 62 (FIG. 2) on the toy vehicle moving in direction D through slot 34 (FIG. 8) and encountering lever arm 116. As lever arm 116 swings, an integral cam plate 126 rotates in direction R about pivot point 128. When this occurs, the cam profile moves a cam follower 132 and swings a lever arm 133 in direction S around a pivot point 134. At the distant end, a star wheel 136 advances one step in response to the well known geneva movement. After the car passes the arm 116, spring 138 pulls the geneva movement lever arm 133 back to the position shown in FIG. 8, thereby advancing star wheel 136 one step.

Figure 10:
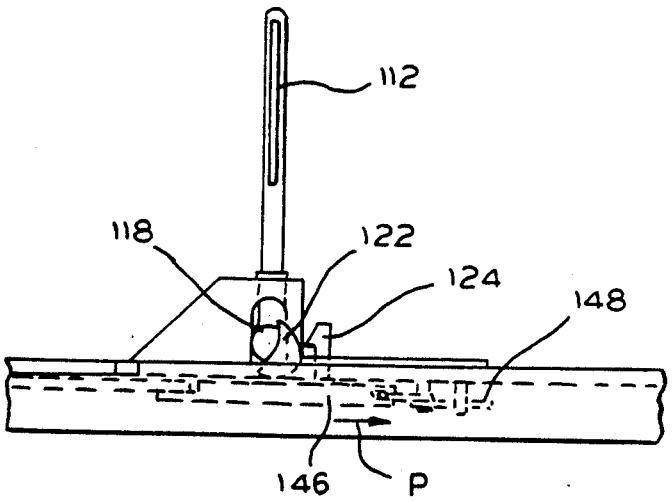
FIG. 10 is the same side elevation with the flag in a raised position.

Normally, wire spring 148 urges slide 140 in direction N. After the star wheel 136 takes a predetermined number of steps, a disk 140 integrally joined with the star wheel 136 moves a cam 142 past a cam follower 144 on a slide 146, which in turn moves in direction P (FIG. 10). When slide 146 moves in direction P, wire spring 148 is flexed. After cam 142 passes cam follower 144, spring 148 pushes slide 146 in direction N to the position seen in FIG. 9. By comparing FIGS. 9, 10, it is seen that when slide 146 moves in direction P, catch 122 is released and the flag pops up. When slide 146 returns to normal under the urging of wire spring 148, the flag may be pushed down to the lowered position. The track is now ready for the next race.

Those who are skilled in the art will readily perceive how to modify the invention. Therefore, the appended claims are to be construed to cover all equivalent structures which fall within the true scope and spirit of the invention.

The claimed invention is:

1. A junction for joining confronting ends of two relatively wide and flat mechanical parts which are molded plastic slot track sections over which at least one toy vehicle moves, each of said parts of said junction comprising an alignment projection pin adjacent one edge and a mating receptacle socket adjacent an opposite edge of said part, said projection pin and receptacle socket telescopingly receiving each other when said track sections are joined in order to cooperatively form box channels, the telescoped projections and receptacles on said confronting ends thus forming a box channel at outside edges of said junction when aligned and joined with said flat parts put together, a hook and an adjacent keeper separate from said box channel and near the center of said track, said hook and keeper being formed on each of said parts for interconnecting them and locking them together when said flat parts are put together, means associated with said hooks for enabling them to be simultaneously disengaged from said keepers while said mechanical parts are being pulled apart, electrical conductive strips embedded in and slots formed on said plastic track for respectively engaging and receiving sliding shoes and a dependent part on a toy vehicle, the strips and slots in adjacent track sections being joined in substantial alignment by said alignment projection and receptacles, said conductive strips being bent into angular shape to form a contact for applying a mutually rubbing and positive contact pressure against each strip at locations where said conductive strips engage each other, said electrical conductive strips being reinforced in said rubbing area by the plastic of said track sections, lap counter means associated with said slot for keeping count of the number of times that said dependent part passes through said slot, and means for signaling when said lap counter means detects a predetermined number of passages of said object through said slot.

2. A slot track racing game comprising at least two adjacent slots in said track for receiving dependent guide pins on toy vehicles, a pair of conductive strips adjacent each of said slots for energizing sliding shoes on said toy vehicles, a box channel on opposite sides of said track formed by telescoping alignment projections and reciprocal sockets, hooks confronting sections of said track for holding together said track sections against misalignment, twisting, and separation with said projections and sockets telescoped together to complete said box channel, means associated with said hooks for enabling a separation of said track sections responsive to simultaneous pressures on said tracks while pulling said sections apart, said track being molded plastic track sections with said conductive strips partially embedded therein on opposite sides of said slot, an end of at least one of said conductive strips being bent to apply a positive rubbing contact pressure against another of said strips.

3. The game of claim 2 and lap counter means operated by a respective one of said guide pins passing through a particular position on said slot, said lap counter means comprising a geneva movement for taking one step responsive to each passage of said guide pin, and means responsive said lap counting means reaching a predetermined count for signalling a winning of a race.

4. The game of claim 2 wherein said hooks are spaced parallel cantilever springs which are near the center of said confronting sections, said box channel includes said alignment projection and receptacles therefor, said cantilever springs having dependent reinforcement for confining bending to an area near the supported end of said cantilever.

5. The game of claim 4 wherein said track sections are molded plastic and said cantilever springs are formed by spaced parallel slots on opposite sides of said hooks, said reinforcement being dependent fins on an underside of said plastic and between said slots for concentrating bending forces in the area at the roots of said slots.

* * * * *